US007294361B2

(12) United States Patent
Dautl et al.

(10) Patent No.: US 7,294,361 B2
(45) Date of Patent: Nov. 13, 2007

(54) METHOD AND DEVICE FOR GAS PHASE DIFFUSION COATING OF METAL COMPONENTS

(75) Inventors: Thomas Dautl, Weichs (DE); Markus Niedermeier, Munich (DE); Horst Pillhoefer, Roehrmoos (DE)

(73) Assignee: MTU Aero Engines GmbH, Munich (DE)

( * ) Notice: Subject to any disclaimer, the term of this patent is extended or adjusted under 35 U.S.C. 154(b) by 418 days.

(21) Appl. No.: 10/250,974

(22) PCT Filed: Jan. 9, 2002

(86) PCT No.: PCT/DE02/00030

§ 371 (c)(1),
(2), (4) Date: Dec. 19, 2003

(87) PCT Pub. No.: WO02/055754

PCT Pub. Date: Jul. 18, 2002

(65) Prior Publication Data

US 2004/0112287 A1 Jun. 17, 2004

(30) Foreign Application Priority Data

Jan. 11, 2001 (DE) ..... 101 01 070

(51) Int. Cl.
*C23C 16/00* (2006.01)

(52) U.S. Cl. ..... 427/253; 427/250; 427/248.1

(58) Field of Classification Search ..... 427/250, 427/248.1, 253

See application file for complete search history.

(56) References Cited

U.S. PATENT DOCUMENTS 4,714,624 A * 12/1987 Naik ..... 148/527
5,071,678 A 12/1991 Grybowski et al.
5,217,757 A 6/1993 Milaniak et al.

(Continued)

FOREIGN PATENT DOCUMENTS

DE 43 40 060 C1 4/1995

(Continued)

OTHER PUBLICATIONS

International Search Report date Jul. 10, 2003.

*Primary Examiner*—Timothy Meeks
*Assistant Examiner*—David Turocy
(74) *Attorney, Agent, or Firm*—Crowell & Moring LLP

(57) ABSTRACT

A process for gas diffusion coating of metallic components; in which a component surface which is to be coated is brought into contact with a metal halide as coating gas, to form a diffusion layer with a defined layer thickness and a defined coating metal content in % by weight in the component surface, working on the basis of a nominal concentration of the metal halide at the component surface which, at a defined coating temperature, leads to a defined coating time, wherein a first concentration, which is higher than the nominal concentration, for the metal halide is established for a first time, and at least one second concentration, which is at or below the nominal concentration, is established at the component surface for at least one second time, the first and the at least one second time being selected in such a way that their sum is shorter than the coating time with the nominal concentration. Also disclosed is a device for the process.

20 Claims, 1 Drawing Sheet

U.S. PATENT DOCUMENTS

| | | | | |
|---|---|---|---|---|
| 5,411,581 | A | 5/1995 | Robinson | |
| 6,120,843 | A * | 9/2000 | Pillhoefer et al. | 427/253 |
| 6,129,991 | A * | 10/2000 | Warnes et al. | 428/610 |
| 6,156,123 | A | 12/2000 | Pillhoefer et al. | 118/715 |
| 6,224,941 | B1 | 5/2001 | Chen et al. | |

FOREIGN PATENT DOCUMENTS

| | | | |
|---|---|---|---|
| DE | 197 30 007 | C1 | 3/1999 |
| EP | 0 480 867 | A2 | 4/1992 |
| EP | 0 671 479 | A1 | 9/1995 |
| EP | 0 897 996 | A1 | 2/1999 |
| EP | 1 013 794 | A2 | 6/2000 |
| EP | 1013794 | A2 * | 6/2000 |
| JP | 63-190158 | | 8/1988 |
| JP | 4-263073 | | 9/1992 |
| JP | 7-000749 | | 1/1995 |
| JP | 7-300663 | | 11/1995 |
| JP | 8-319557 | | 12/1996 |
| JP | 11-172463 | | 6/1999 |
| JP | 2000-192230 | | 7/2000 |

* cited by examiner

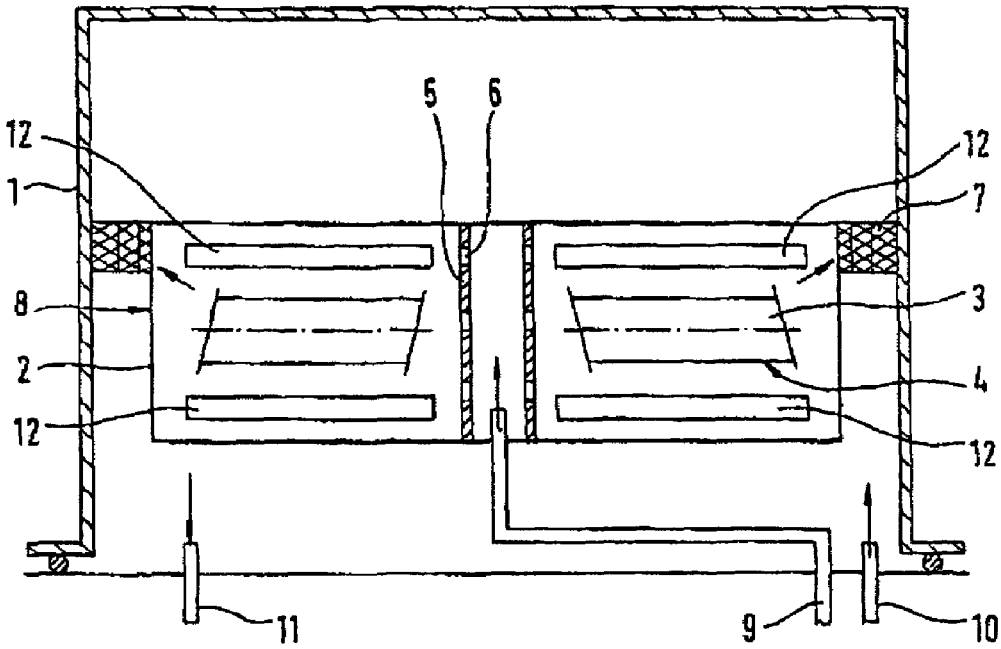
Fig.1
Fig.2
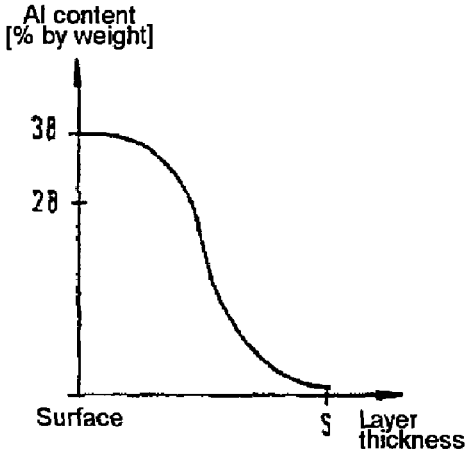
Fig.3
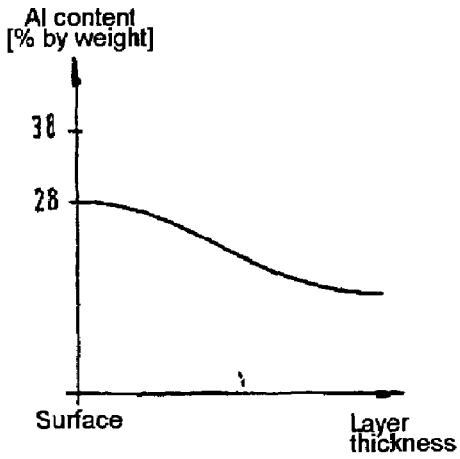

METHOD AND DEVICE FOR GAS PHASE DIFFUSION COATING OF METAL COMPONENTS

The invention relates to a process for gas-phase diffusion coating of metallic components, in particular components of gas turbines, in which a component surface which is to be coated is brought into contact with a metal halide as coating gas, to form a diffusion layer with a defined layer thickness and a defined coating metal content in % by weight in the component surface, working on the basis of a nominal concentration of the metal halide at the component surface which, at a defined coating temperature, leads to a defined coating time, and to a device for carrying out the process.

Diffusion layers of this type are generally used as layers to protect against hot-gas corrosion and oxidation or as a bonding base for thermal barrier coatings.

The starting point is a nominal concentration of the metal halide at the component surface in a known process, which, to form a diffusion layer with a layer thickness in the range from 50 to 100 μm and a coating metal content of 25 to 32% by weight in the component surface, leads to a defined, reproducible coating time of 14 hours. Alternative diffusion layers with other layer thickness ranges and/or coating metal contents can lead to coating times of, for example, 20 h. In the case of a material which is relatively difficult to coat, such as an Ni-base alloy which has solidified in single crystal form, a longer coating time is required for otherwise identical conditions.

The problem on which the present invention is based consists in providing a process of the generic type described in the introduction which allows diffusion layers with a defined layer thickness and a defined coating metal content in % by weight in the component surface to be produced as economically as possible, i.e. saving coating time. Furthermore, it is intended to provide a device for vapor-phase diffusion coating of metallic components in accordance with the above-mentioned process.

With regard to the process, according to the invention the solution to this problem is characterized in that a first concentration, which is higher than the nominal concentration, for the metal halide is established for a first (coating) time, and at least one second concentration, which is at or below the nominal concentration, being established at the component surface for at least one second (coating) time, the first and the at least one second time being selected in such a way that their sum is shorter than the coating time with the nominal concentration.

It has proven advantageous in this process that, on account of the high first concentration of the metal halide at the component surface in the first time, there is a considerable difference in concentration with respect to the component right at the start of the process, since initially the component generally contains little or no element which is identical to the coating metal, e.g. Al, or Cr. On account of the considerable momentum, this leads to rapid introduction of a large number of coating metal atoms into the surface of the component. After the first time has ended, therefore, the component surface has a very high level of coating metal atoms which, however, is only present over a small layer thickness. In the second time, the high coating metal content at the component surface leads to a higher coating metal content in the depth of the component as a result of diffusion phenomena and to a lower level at the component surface which, after the second time has ended, leads to a diffusion layer with the desired coating metal content in % by weight in the component surface and the desired layer thickness.

The high first concentration in the first time is produced by an excess supply of metal halide and is eliminated again in the second time by dilution (supply of inert gas or hydrogen).

The metal halide can be produced by reacting a halogen or a halide with a coating metal which is present in a donor source, the halogen or halide being in powder or granule form in the donor source; alternatively, it can be fed to the reaction chamber in which the components are arranged by a feed device. In the latter case, the second concentration can be set by reducing the supply of halogen or halide.

The metal halide may preferably contain F or Cl.

The coating metal provided may be Al and/or Cr and, if appropriate, further elements such as Si, Hf, Y, in order to protect the coated component surfaces from oxidation and/or corrosion.

To achieve a good level of action, a diffusion layer with a layer thickness of 50 to 100 μm and a coating metal content of 25 to 32% by weight in the component surface is formed.

The first time with the first concentration, which is higher than the nominal concentration, may preferably be set to between 2 and 10 hours, preferably between 5 and 6 hours, and the at least one second time, with the second concentration, which is below the nominal concentration, may preferably be set to between 1 and 6 hours, preferably between 3 and 4 hours.

The high momentum during the first time and the associated high level of introduction of coating metal atoms into the component surface allows a second concentration in a second time to be set to approximately zero, so that the layer thickness increases through diffusion of the coating metal atoms which are already present in the component surface.

The at least one second concentration may be set, for example, by supplying an inert gas, such as argon, or hydrogen into the reaction chamber in which the components which are to be coated are arranged, or by reducing the supply of halogen or halide which is fed in.

Before the diffusion layer is formed, Pt may be deposited on the component surface by electrodeposition and if appropriate heat-treated, since diffusion layers which in addition to the coating metal also contain Pt or Pd offer even better protection against high-temperature oxidation and corrosion. With Al as the coating metal, a PtAl diffusion layer has a good level of action if the Al content in the surface is in the range from 18 to 25% by weight.

Before the diffusion layer is formed, further elements, such as Pt, Si, Y, Hf or mixtures of the MCrAlY type (with Ni, Co as M) may also be applied to the component surface as a slip or a plasma-sprayed layer, in order to further improve specific properties of the diffusion layer, such as resistance to oxidation or ductility.

The pressure of the coating gas can be varied at least from time to time during the first and/or second time, it preferably being possible for this variation to take place intermittently. It is possible to switch between standard pressure and reduced pressure by suction out of a reaction vessel which accommodates the components which are to be coated or out of a retort in which at least one reaction vessel is arranged. The reduced pressure is preferably set to a pressure in the range from standard pressure to 100 mbar. Particularly in the case of cavities which are to be coated, changing the pressure leads to improved penetration of the coating metal and to shorter coating times. By reducing the pressure, it is also possible to set the lower, second concentration in the second time.

The present invention further provides a device for gas diffusion coating of metallic components, the device comprising at least one reaction chamber (2) which accommodates the components (3) to be coated, has at least one donor source (12) and has a distributor device (5) for supplying halogen or halide and at least one semipermeable seal (7) for discharging gases. In a preferred embodiment, the device further comprises a retort (1), in which at least one reaction vessel (2) is arranged. In another preferred embodiment, the retort (1) has a feed line (10) for an inert gas and a discharge line (11) for gases. Preferably, the distributor device (5) is arranged centrally and the semipermeable seal (7) is arranged at an outer periphery (8) of the reaction vessel (2).

In the text which follows, the invention is explained in more detail on the basis of an exemplary embodiment and with reference to drawings, in which:

FIG. 1 shows an exemplary embodiment of a device for carrying out the gas-diffusion coating process according to the invention, FIG. 2 shows a diagram in which the Al content is plotted against the layer thickness at the end of the first time, and FIG. 3 shows a diagram in which the Al content is plotted against the layer thickness at the end of the second time.

FIG. 1 shows a device for carrying out the process, having a heatable retort 1 in which at least one reaction vessel 2 is arranged. Depending on the size, it is possible for a plurality of reaction vessels 2 to be arranged above and/or next to one another in the retort 1. A plurality of diagrammatically depicted components 3 of a gas turbine, such as turbine blades or vanes, are arranged with their surfaces 4 which are to be coated in the reaction vessel 2, which is of rotationally symmetrical design in the present configuration, and are held suitably. The components 3 are substantially radially oriented.

The reaction vessel 2 has a centrally arranged distributor device 5 with openings 6 which are illustrated on an enlarged scale in the drawing and are distributed substantially uniformly over its height and periphery. As an alternative to the openings 6, it is also possible to provide tubes which extend radially outwards into the reaction vessel 2 and which each has a multiplicity of openings or nozzles. Furthermore, the reaction vessel 2 has at least one semipermeable seal 7, through which gases can escape from the reaction vessel 2. In the present case, the reaction vessel 2 is provided with a semipermeable seal 7 which runs around the outer periphery 8.

A halogen or halide for generating the coating gas by reaction with the coating metal and/or inert gas and/or hydrogen can be supplied through a feed line 9 which opens out into the central distributor device 5, flows out uniformly into the reaction vessel 2 from its center through the central distributor device 5 and escapes via the semipermeable seal 7. The retort 1 has a feed line 10, through which inert gas, such as for example argon, is supplied for purging purposes before the process commences, in order to substantially remove $O_2$ so as to avoid oxidation.

In the present configuration of the process, the turbine blades or vanes 3 comprising a nickel-base or cobalt-base alloy are to be coated with an aluminium diffusion layer with an Al content at the surface of 25 to 32% by weight and a layer thickness of 60 to 90 μm, to protect against hot-gas oxidation. For this purpose, a multiplicity of guide vanes, e.g. 100 guide vanes, are arranged in the reaction chamber 2 and held in a suitable way, so that the surface 4 which is to be coated is in each case freely accessible to the coating gas.

A plurality of donor sources 12 for the coating metal Al which is selected in this case are provided in the reaction chamber 2 in the form of vessels which contain the coating metal in powder or granule form. The donor sources 12 are arranged as close as possible to the turbine blades or vanes 3, in order to achieve the desired high, first concentration in the first time. The selected coating metal AlCr is present in granule form and in sufficient quantity, so that a plurality of batches of turbine blades or vanes can be coated consecutively. In addition, in the donor source 12 there is an F-containing halide which at the coating temperature reacts with the coating metal to form a metal halide (coating gas).

Before the process begins, an inert gas, such as argon, is fed into the retort 1 via the feed line 10 for purging purposes, in order to substantially remove $O_2$ and $H_2O$ from the retort 1, so as to avoid oxidation. During the subsequent heating operation 1 to the coating temperature in the range from 1000 to 1100° C., preferably 1080° C., initially no gas is fed to the reaction vessel 2 via the feed line 9. Beyond a temperature of approximately 700° C., hydrogen ($H_2$) is fed to the retort 1 via the feed line 10 and to the reaction chamber 2 via the feed line 9 or the distributor device 5. Once a temperature of 1000° C. is reached, the supply of hydrogen to the reaction chamber 2 is ended.

After the coating temperature of 1080° C. has been reached, this temperature is held for a first time of approximately six hours. Under these conditions, the concentration of metal halide is such that it leads to an Al content of approximately 38% by weight in the component surface. Immediately thereafter, hydrogen is fed to the reaction chamber 2 at the start of the second time, via the feed line 9 and the distributor device 5, with the result that the concentration of metal halide at the surfaces 4 of the turbine blades or vanes 3 which are to be coated is considerably reduced. This is achieved firstly as a result of the dilution in the reaction vessel 2 and secondly through the fact that, as a result of the excess hydrogen, the metal halide which forms coating gas reacts to form hydrogen halides. These conditions are held for the second time of four hours. After the second time has ended, the retort 1 and the reaction chamber 2 are cooled to room temperature by feeding in 1 $m^3/h$ of inert gas (argon) via the feed line 10 and/or 9.

Therefore, in total the invention requires only 10 hours to produce the diffusion layer with the desired coating parameters.

In an alternative configuration of the process, an inert gas is fed to the reaction chamber 2 via the feed line 9 and the distributor device 5 at the start of the second time in order to set the second concentration of the metal halide at the component surface 4 which is lower than the nominal concentration.

To further improve the effectiveness of the diffusion layer to protect against hot-gas oxidation and corrosion, an Al diffusion layer may contain Pt or Pd; in a configuration of this type, by way of example first of all Pt is deposited on the component surface by electrodeposition in a layer thickness of for example 5 μm and may if appropriate be heat-treated. Then, the process according to the invention is carried out in the manner which has been described above. On account of the high momentum of the process according to the invention as a result of the high Al concentration in the first coating time, Al can diffuse through the Pt layer into the component surface. In this way, it is possible to produce a PtAl diffusion layer with a layer thickness of 70 μm which, at a depth of 5 μm, has an Al content of approximately 24% by weight and a Pt content of approximately 21% by weight, and at a depth of 15 μm has an Al content of approximately 23% by weight and a Pt content of approximately 18% by weight, and therefore has an advantageous ratio between Al and Pt.

FIG. 2 shows a diagram in which, by way of example for Al, the coating metal content in % by weight is plotted against the layer thickness after the end of the first time, i.e. the coating with the first concentration which is higher than the nominal concentration. The high momentum which is associated with the high concentration leads to an Al content of 38% in the surface of the component, which is above the desired Al content in the range from 25 to 32% by weight. The layer thickness S of the diffusion layer is low after the first time has ended and is well below the desired layer thickness of 50 to 100 μm.

The diagram shown in FIG. 3 plots the Al content against the layer thickness after the end of the second time, i.e. at the end of the coating process. The diffusion of the Al atoms into the component has led to the desired Al content of 28% by weight being established at the component surface. The distribution of Al is considerably more uniform and leads to growth of the layer thickness to the desired range from 50 to 100 μm.

The invention claimed is:

1. A process for gas-phase diffusion coating of a metallic component, comprising the steps of:

defining a concentration of a metal halide as a coating gas at a surface of the metallic component that, for a defined coating time period, results in a defined diffusion coating layer;

coating the surface of the metallic component with a first concentration of the metal halide for a first time period in a first coating process, wherein the first concentration is greater than the defined concentration; and coating the surface of the metallic component with a second concentration of the metal halide for a second time period in a second coating process, wherein the second concentration is lower than the defined concentration and greater than zero;

wherein a sum of the first time period for the first coating process and the second time period for the second coating process is less than the defined coating time period, wherein a diffusion coating layer on the metallic component that results from the first coating process and the second coating process equals the defined diffusion coating layer, and wherein the first coating process and the second coating process are conducted in succession without an intermediate purging process step.

2. A process according to claim 1, wherein the metal halide is produced by reacting a halogen or a halide with a coating metal which is present in a donor source.

3. A process according to claim 1, wherein the metal halide comprises F or Cl.

4. A process according to claim 1, wherein at least one of Al, Cr, or an alloy thereof is provided as a coating metal.

5. A process according to claim 4, wherein the coating metal further comprises one or more of Si, Pt, Pd, Hf, or Y.

6. A process according to claim 1, wherein a diffusion coating layer with a layer thickness of about 25 to about 100 μm is formed.

7. A process according to claim 6, wherein the first time period is set at between about 5 and 6 hours and the second time period is set at between about 3 and 4 hours.

8. A process according claim 1, wherein a diffusion coating layer with a coating metal content of 25 to 32% by weight is formed in the component surface.

9. A process according to claim 8, wherein the first time period is set at between about 5 and 6 hours and the second time period is set at between about 3 and 4 hours.

10. A process according to claim 1, wherein the first time period is set at between about 2 and 10 hours, and the second time period is set at between about 1 and 6 hours.

11. A process according to claim 1, wherein a coating temperature in the range from about 900 to 1200° C. is held during the first and second time periods.

12. A process according to claim 11, wherein a coating temperature in the range from 1000 to 1100° C. is held during the first and second time periods.

13. A process according to claim 1, wherein the second concentration in the second time period is set to approximately zero.

14. A process according to claim 1, wherein the second concentration is set by supplying an inert gas or hydrogen or by reducing a supply of halogen or halide.

15. A process according to claim 1, wherein before the diffusion coating layer is formed, Pt is deposited on the component surface by electrodeposition.

16. A process according to claim 1, wherein before the diffusion coating layer is formed, at least one additional element, mixture, or alloy is deposited as a slip or plasma-sprayed onto the component surface.

17. A process according to claim 16, wherein the element is selected from the group consisting of Pt, Si, Y, or Hf.

18. A process according to claim 16, wherein the alloy is MCrAlY, wherein M is Ni or Co, or both.

19. A process according to claim 1, wherein in the first or second time periods, or both, a pressure of the coating gas is varied at least from time to time.

20. A process according to claim 1, wherein the second concentration is set by reducing a pressure.

* * * * *